US006481594B1

(12) United States Patent
Yeh et al.

(10) Patent No.: US 6,481,594 B1
(45) Date of Patent: Nov. 19, 2002

(54) ROLL MOUNTED T-SHIRT STYLE PRODUCE BAG AND DISPENSERS FOR SAME

(75) Inventors: Ron C. Yeh, Morganville, NJ (US); Ben Tseng, East Brunswich, NJ (US)

(73) Assignee: Inteplast Group, Ltd., Livingston, NJ (US)

( * ) Notice: Subject to any disclaimer, the term of this patent is extended or adjusted under 35 U.S.C. 154(b) by 0 days.

(21) Appl. No.: 09/927,750

(22) Filed: Aug. 8, 2001

Related U.S. Application Data

(63) Continuation-in-part of application No. 09/843,347, filed on Apr. 27, 2001.

(51) Int. Cl.[7] ..... B65H 1/00

(52) U.S. Cl. ..... 221/63; 383/8; 383/10; 428/906; 225/96; 225/106; 242/423.2

(58) Field of Search ..... 225/42, 47, 106, 225/96; 242/423.2, 570, 598.2; 221/33, 63; 428/906; 383/8, 10, 32, 121

(56) References Cited

U.S. PATENT DOCUMENTS 4,714,191 A * 12/1987 Richardson ..... 225/106
5,011,298 A * 4/1991 Bose et al. ..... 383/8
5,170,957 A * 12/1992 Carpenter ..... 221/63
5,209,371 A * 5/1993 Daniels ..... 221/63
RE34,856 E * 2/1995 Daniels et al. ..... 221/63
5,464,098 A * 11/1995 Tseng et al. ..... 383/8
5,556,019 A * 9/1996 Morris ..... 225/106
5,558,262 A * 9/1996 Simhaee ..... 225/106
5,813,585 A * 9/1998 Kannankeril et al. ..... 225/106
5,934,535 A * 8/1999 Kannankeril et al. ..... 225/106

* cited by examiner

*Primary Examiner*—H. Grant Skaggs
(74) *Attorney, Agent, or Firm*—David A. Belasco; Belasco Jacobs & Townsley, LLP

(57) ABSTRACT

A roll mounted T-shirt bag and dispensers for same are described. The bag is designed for fresh produce and includes front and rear panels, first and second side gussets, a bottom seam, a top seam and a U-shaped cutout forming an openable bag mouth and a pair of carrying handles. The bags are joined above and below the upper and lower seams at first and second perforation lines. The bags are wound onto a cylindrical core to form a compact roll. In a variant of the invention, the bags are folded inwardly from the side edges prior to rolling onto the core to form a more compact roll. Dispensers are described that are designed to hold the roll mounted bags in both folded and unfolded form. The dispensers include a separating tongue designed to engage the U-shaped cutout and permit the bags to be dispensed from the bottom of the bag roll. The dispensers are designed for mounting to either vertical or horizontal surfaces and function efficiently in very limited spaces.

10 Claims, 8 Drawing Sheets

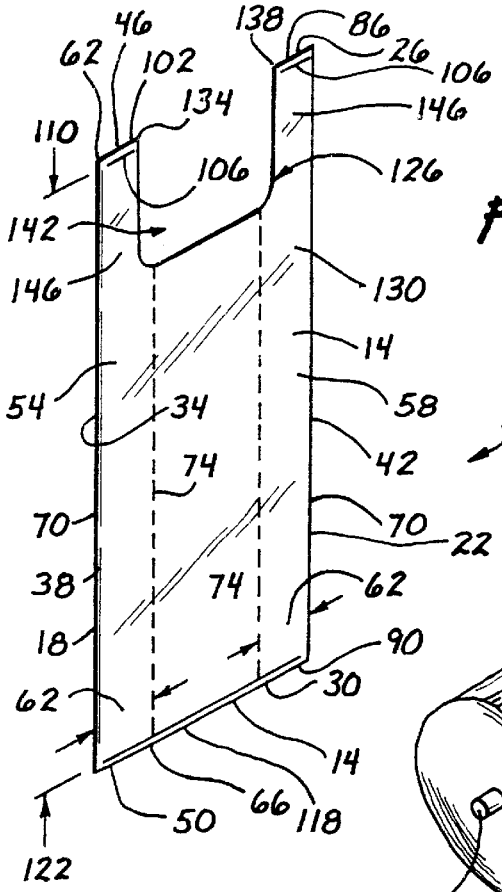
Fig. 1
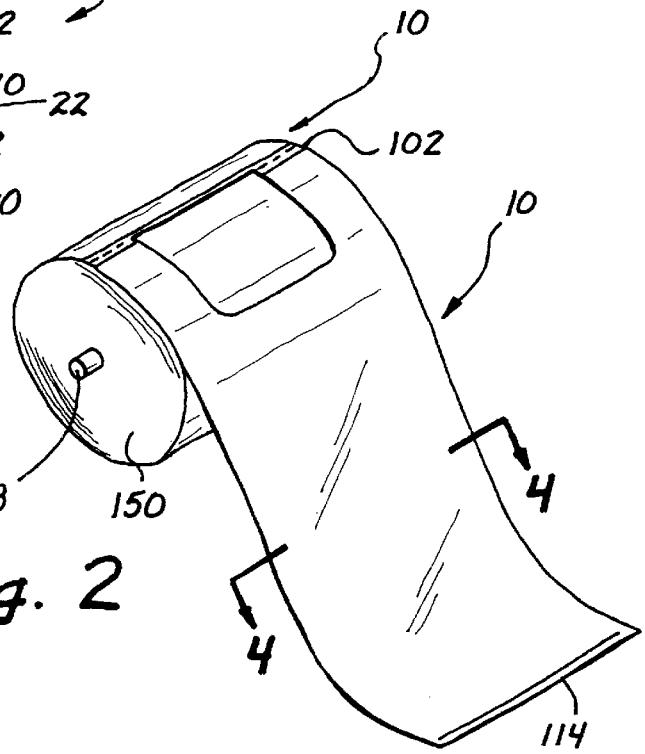
Fig. 2
Fig. 4
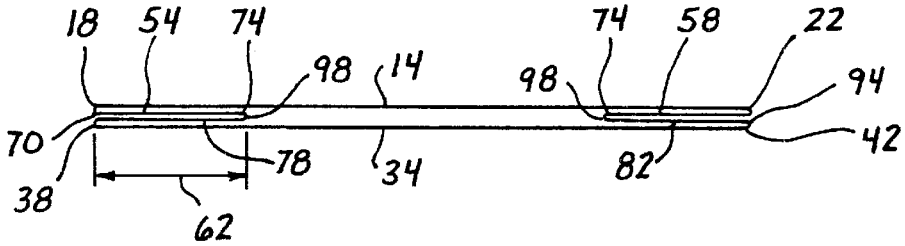

Fig. 14
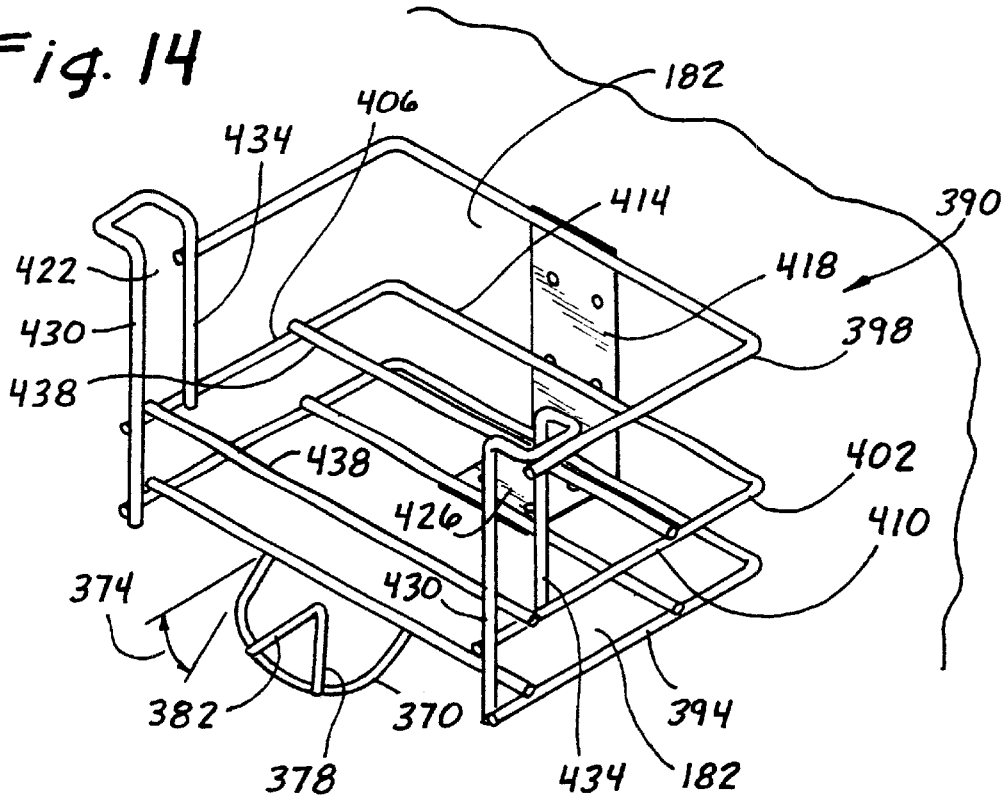
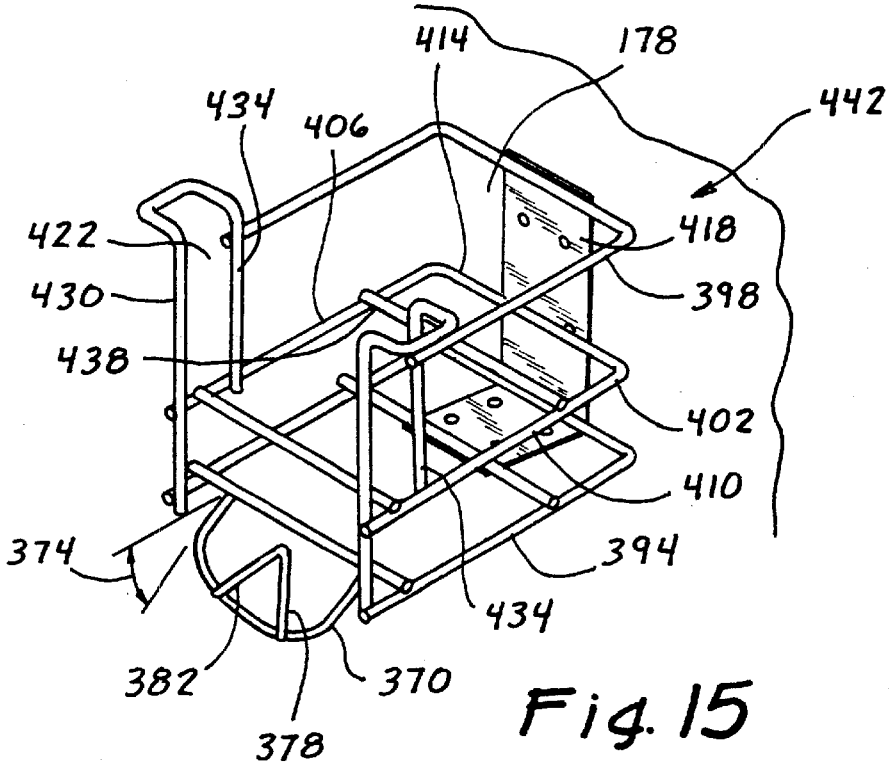
Fig. 15

ROLL MOUNTED T-SHIRT STYLE PRODUCE BAG AND DISPENSERS FOR SAME

EARLIER FILED APPLICATION

The instant application is a continuation-in-part of applicant's prior application filed Apr. 27, 2001 and having Ser. No. 09/843,347, the disclosure of which is specifically incorporated by reference herein.

FIELD OF INVENTION

The invention pertains to dispensers for plastic produce bags. More particularly, the invention relates to dispensers for expandable plastic film gusseted bags having integral carrying handles designed for roll dispensing.

BACKGROUND OF THE INVENTION

Roll mounted produce bags are commonly found in modern grocery stores and supermarkets. These bags are designed for customers to use when purchasing fresh produce. The bags currently available are difficult for customers to use for several reasons. First, the bags tend to cling together and are difficult to separate from the roll. Second, it is difficult to tell the open end of the bag from the closed end of the bag. Third, the bags are difficult to open, as the sides tend to cling together. Fourth, the bags do not provide carrying handles. A roll-mounted produce bag that identifies the proper end to open is partially opened by the dispensing rack and that provides carrying handles would save time and effort for produce purchasers.

Various designs have been developed for dispensers for roll mounted bags, incorporating a number of different technologies. U.S. Pat. No. 4,179,055 issued to Milner discloses a device for separating a continuous strip of plastic bags mounted on a roll separated by score lines. The bags pass between a plate and a pressure bar. A prong projects outwardly from the center portion of the plate to facilitate separation of the bags along the score lines and to display the next bag for easy grasping by an operator.

U.S. Pat. No. 4,714,191 issued to Richardson, describes a one piece paperboard carton blank folded into a rectangular shape for packaging and dispensing from a roll of individual plastic bags, particularly disposable milk bags for feeding babies. The individual bags are connected by perforations. The carton includes a tab protruding in the direction opposite to the direction of withdrawal of bags from the roll. When the center of the perforated edge of a bag is impaled on the tab, further withdrawal of a succeeding bag is restrained and the first bag is readily separated to facilitate its dispensing while locating the leading edge of the succeeding bag where it may be easily reached for withdrawal.

U.S. Pat. No. 5,558,262 issued to Simhaee, discloses a plastic bag dispenser that holds a continuous roll of bags connected by perforated separation lines. The dispenser is provided with a tongue, which the bags are dispensed over, that engages the separation line between the bag at the end of the roll and the next bag. The roll of bags rests in curved grooves in the dispenser that cause the roll to abut and frictionally engage an interior surface of the dispenser, preventing freewheeling of the roll.

U.S. Pat. No. 5,556,019 issued to Morris, describes a bag separator and dispenser for use with bags wound on a core and separated by perforation lines at each end of the bags. The perforation lines include a slot that is collinear with the perforations and is used to engage a separator projection.

The projection enters the slot as the bags are pulled from the roll. The dispenser includes two braking devices to control the removal of bags from the roll, a braking bar underneath the roll of bags and a pair of fingers that are attached to the channel for the core and are designed to engage the core as the number of bags on the roll decreases.

U.S. Pat. No. 5,934,535, issued to Kannankeril discloses a roll of bags having a core with an indexing member on at least one end. The dispenser comprises a wire frame formed into channels to support the core. The dispenser includes at least one brake attached to a support member and disposed at an angle to the support member to provide tension to the edges of the roll of bags as the core passes through the channel passageway as bags are removed from the roll. Spaced apart from the support is a separating tongue. The tongue engages the slot regardless of whether the bags are drawn over or under the tongue.

While other variations exist, the above-described designs for dispensers for roll mounted bags are typical of those encountered in the prior art.

It is an objective of the present invention to provide a dispenser for a T-shirt type produce bag that can be mounted on a continuous roll. It is a further objective to provide such a dispenser that can be easily and inexpensively manufactured in a variety of sizes that is durable and easy to use. It is a still further objective of the invention to provide a dispenser that initiates opening of the roll-mounted bag for a user. It is yet a further objective to provide a dispenser that will permit a user to open a bag with one hand. In is another objective of the invention to provide a dispenser that can dispense bags from the top or the bottom of the roll. It is still another objective to provide a dispenser that will insure that the bag roll cannot be inadvertently pulled from the dispenser, allowing contamination of the bag roll. Finally, it is an objective of the invention that the dispenser is capable of identifying for the user the open end of the bags.

While some of the objectives of the present invention are disclosed in the prior art, none of the inventions found include all of the requirements identified. The present invention addresses many of the deficiencies of prior art roll mounted bags and dispensers and satisfies all of the objectives described above.

SUMMARY OF THE INVENTION

A roll mounted plastic produce bag providing the desired features may be constructed from the following components. A front panel has first and second parallel linear side edges, a top edge and a bottom edge. A rear panel has first and second parallel linear side edges, a top edge and a bottom edge. Two front gusset panels of a first predetermined dimension are provided. Each front gusset panel has a top edge, a bottom edge, first and second parallel side edges. The front gusset panels are connected at the first side edge to one of the linear side edges of the front panel and extend from the top edge to the bottom edge of the front panel.

Two rear gusset panels of the first predetermined dimension are provided. Each rear gusset panel has a top edge, a bottom edge, first and second parallel side edges. The rear gusset panels are connected at the first side edge to one of the linear side edges of the rear panel and extend from the top edge to the bottom edge of the rear panel. Each front gusset panel is also connected to a respective one of the rear gusset panels at the second side edge. Each of the front and rear gusset panels is folded inwardly relative to the front and the rear panel.

The top edges of the front panel, the rear panel, the front gusset panels and the rear gusset panels terminate in a first perforation line. The first perforation line is perpendicular to the linear side edges of the front and rear panels. An upper seam connects the front panel, the rear panel, the front gusset panels and the rear gusset panels at a level spaced downwardly from and parallel to the first perforation line. The bottom edges of the front panel, the rear panel, the front gusset panels and the rear gusset panels terminate in a second perforation line. The second perforation line is perpendicular to the linear side edges of the front and rear panels. A lower seam connects the front panel, the rear panel, the front gusset panels and the rear gusset panels at a level spaced upwardly from and parallel to the second perforation line.

A U-shaped cutout is located in an upper portion of the bag. The U-shaped cutout begins at a first point along the first perforation line. The point is spaced inwardly from the first linear side edge and extends to a second point along the first perforation line. The second point is spaced inwardly from the second linear side edge. The cutout extends downwardly toward the lower seam, forming an open mouth and a pair of bag handles. The second perforation line attaches the bag to a subsequent bag. The bags are rolled from their upper seams toward their lower seams onto a cylindrical core to form a compact roll from which the bags are dispensed.

In a variant of the invention, the bag is folded inwardly from the first and second linear side edges for a third predetermined dimension prior to rolling the bags onto a cylindrical core, thereby providing a more compact roll of bags.

In a further variant, a dispenser for roll mounted plastic produce bags includes a supporting base and a surrounding upper member. The upper member is spaced upwardly from the supporting base and sized and shaped to enclose at least a rear portion of a bag roll. An attachment member is provided. The attachment member is fixedly attached to the supporting base and the surrounding upper member and provides means for securing the dispenser to either a vertical surface or a horizontal surface.

First and second parallel, upwardly angled slots are provided. Each of the slots has a front edge member and a rear edge member. The slots extend upwardly from the supporting base and connect to and extend above the surrounding upper member. The slots are sized, shaped and located to slidably constrain first and second ends of a cylindrical produce bag core on which the bags are wound in a roll. The angled slots permit the bag core to slide downwardly within the slots. First and second core supports are provided. The core supports are located adjacent upper ends of the first and second slots and provide a bearing surface for the produce bag core.

A bag constraining ring is provided. The constraining ring is mounted between the front edge members of the upwardly angled slots and is sized and shaped to fit frictionally about a bag as it is removed from the bag roll. Upper and lower separating tongues are provided. The upper and lower tongues are affixed to upper and lower portions of the bag constraining ring, respectively. The upper and lower tongues point toward an interior of the ring and are sized and shaped to locate the U-shaped cutout in the upper portion of the bags as bags are pulled from the bag roll.

When a roll of T-shirt style bags is mounted in the dispenser with its core resting upon the first and second core supports, the roll may be arranged to dispense bags from either of a top and bottom of the bag roll. When a leading bag from the roll is fed through the constraining ring adjacent either the upper or lower separating tongues, one of the tongues will serve to engage the U-shaped cutout in the upper portion of the bag and facilitate tearing of the perforation joining the leading bag to a subsequent bag on the roll.

In still a further variant of the invention, a dispenser is sized and shaped to accommodate produce bags that have been folded inwardly from the first and second linear side edges for a third predetermined dimension prior to rolling the bags onto a cylindrical core, thereby providing a more compact roll of bags.

In another variant of the invention, a dispenser for roll mounted plastic produce bags includes a supporting base and a surrounding upper member. The upper member is spaced upwardly from the supporting base and is sized and shaped to enclose at least a rear portion of a bag roll. A surrounding intermediate member is provided. The intermediate member has a first side, a second side and a rear portion. The intermediate member is spaced upwardly from the supporting base and downwardly from the surrounding upper member and is sized and shaped to enclose at least a rear portion of the bag roll. An attachment member is provided. The attachment member is fixedly attached to the supporting base, the surrounding intermediate member and the surrounding upper member and provides means for securing the dispenser to either a vertical surface or a horizontal surface.

First and second parallel, upwardly angled slots are provided. Each of the slots has a front edge member and a rear edge member and extends upwardly from the surrounding intermediate member and above the surrounding upper member and is sized, shaped and located to slidably constrain first and second ends of a cylindrical produce bag core on which the bags are wound in a roll. The angled slots permit the bag core to slide downwardly within the slots. At least one roll bearing bar is provided. The roll bearing bar extends from the first side of the surrounding intermediate member to the second side of the surrounding intermediate member.

A bag constraining ring is provided. The constraining ring is mounted between the front edge members of the upwardly angled slots and is sized and shaped to fit frictionally about a bag as it is removed from the bag roll. Upper and lower separating tongues are provided. The upper and lower tongues are affixed to upper and lower portions of the bag constraining ring, pointing toward an interior of the ring. The upper and lower tongues are sized and shaped to locate the U-shaped cutout in the upper portion of the bags as bags are pulled from the bag roll.

When a roll of T-shirt style bags is mounted in the dispenser with its core disposed between the front edge member and the rear edge member of the first and second parallel, upwardly angled slots, the roll may be arranged to dispense bags from either a top or bottom of the bag roll. The bag roll rests upon the roll bearing bar and the bar controls movement of the bag roll. When a leading bag from the roll is fed through the constraining ring adjacent either of the upper and lower separating tongues, one of the tongues will serve to engage the U-shaped cutout in the upper portion of the bag and facilitate tearing of the perforation joining the leading bag to a subsequent bag on the roll.

In yet another variant of the invention a dispenser for roll mounted plastic produce bags is sized and shaped to accommodate produce bags that have been folded inwardly from the first and second linear side edges for a third predetermined dimension prior to rolling the bags onto a cylindrical core, thereby providing a more compact roll of bags.

7—In still another variant, a dispenser for roll mounted plastic produce bags includes a supporting base and a surrounding upper member. The upper member is spaced upwardly from the supporting base and sized and shaped to enclose at least a rear portion of a bag roll. An attachment member is provided. The attachment member is fixedly attached to the supporting base and the surrounding upper member and provides means for securing the dispenser to either a vertical surface or a horizontal surface.

First and second parallel, upwardly angled slots are provided. Each of the slots has a front edge member and a rear edge member. The slots extend upwardly from the supporting base and connect to and extend above the surrounding upper member. The slots are sized, shaped and located to slidably constrain first and second ends of a cylindrical produce bag core on which the bags are wound in a roll. The angled slots permit the bag core to slide downwardly within the slots. First and second core supports are provided. The core supports are located adjacent upper ends of the first and second slots and provide a bearing surface for the produce bag core.

A tongue mounting loop is provided. The mounting loop is attached between the front edge members of the upwardly angled slots and is positioned at an acute angle to the supporting base. A separating tongue is provided. The separating tongue is affixed to a perimeter of the tongue mounting loop, pointing inwardly from the perimeter, upwardly at the acute angle to the supporting base and is sized and shaped to locate the U-shaped cutout in the upper portion of the bags as bags are pulled from the bag roll.

When a roll of T-shirt style bags is mounted in the dispenser with its core resting upon the first and second core supports, the roll is arranged to dispense bags from the bottom of the bag roll, a leading bag from the roll is fed over the tongue mounting loop adjacent the separating tongue, the tongue will serve to engage the U-shaped cutout in the upper portion of the bag and facilitate tearing of the perforation joining the leading bag to a subsequent bag on he roll.

8—In yet another variant of the invention, a dispenser is sized and shaped to accommodate produce bags that have been folded inwardly from the first and second linear side edges for a third predetermined dimension prior to rolling the bags onto a cylindrical core, thereby providing a more compact roll of bags.

9—In still another variant of the invention, a dispenser for roll mounted plastic produce bags includes a supporting base and a surrounding upper member. The upper member is spaced upwardly from the supporting base and is sized and shaped to enclose at least a rear portion of a bag roll. A surrounding intermediate member is provided. The intermediate member has a first side, a second side and a rear portion. The intermediate member is spaced upwardly from the supporting base and downwardly from the surrounding upper member and is sized and shaped to enclose at least a rear portion of the bag roll. An attachment member is provided. The attachment member is fixedly attached to the supporting base, the surrounding intermediate member and the surrounding upper member and provides means for securing the dispenser to either a vertical surface or a horizontal surface.

First and second parallel, upwardly angled slots are provided. Each of the slots has a front edge member and a rear edge member and extends upwardly from the surrounding intermediate member and above the surrounding upper member and is sized, shaped and located to slidably constrain first and second ends of a cylindrical produce bag core on which the bags are wound in a roll. The angled slots permit the bag core to slide downwardly within the slots. At least one roll bearing bar is provided. The roll bearing bar extends from the first side of the surrounding intermediate member to the second side of the surrounding intermediate member.

A tongue mounting loop is provided. The mounting loop is attached between the front edge members of the upwardly angled slots and is positioned at an acute angle to the supporting base. A separating tongue is provided. The separating tongue is affixed to a perimeter of the tongue mounting loop, pointing inwardly from the perimeter, upwardly at the acute angle to the supporting base and is sized and shaped to locate the U-shaped cutout in the upper portion of the bags as bags are pulled from the bag roll.

When a roll of T-shirt style bags is mounted in the dispenser with its core disposed between the front edge member and the rear edge member of the first and second parallel, upwardly angled slots, the roll is arranged to dispense bags from the bottom of the bag roll. The bag roll rests upon the roll bearing bar, the bar controlling movement of the bag roll and when a leading bag from the roll is fed over the tongue mounting loop adjacent the separating tongue, the tongue will serve to engage the U-shaped cutout in the upper portion of the bag and facilitate tearing of the perforation joining the leading bag to a subsequent bag on the roll.

10—In a final variant of the invention, a dispenser is sized and shaped to accommodate produce bags that have been folded inwardly from the first and second linear side edges for a third predetermined dimension prior to rolling the bags onto a cylindrical core, thereby providing a more compact roll of bags.

DESCRIPTION OF THE DRAWINGS

FIG. 1 is a perspective view of the preferred embodiment of the T-shirt style bag of the present invention illustrating a pair of side gussets, upper and lower seams and an openable mouth;

FIG. 2 is a perspective view of a plurality of the FIG. 1 embodiment bags rolled onto a cylindrical core suitable for a dispenser;

FIG. 4 is a cross sectional view of the FIG. 2 bags taken along the line 6A—6A;

FIG. 14 is a perspective view of a fourth embodiment of a dispenser suitable for the FIG. 1 rolled bags;

FIG. 15 is a perspective view of the fourth embodiment of a dispenser suitable for the FIG. 1A rolled bags.

DETAILED DESCRIPTION OF THE PREFERRED EMBODIMENT

Figure 1A:
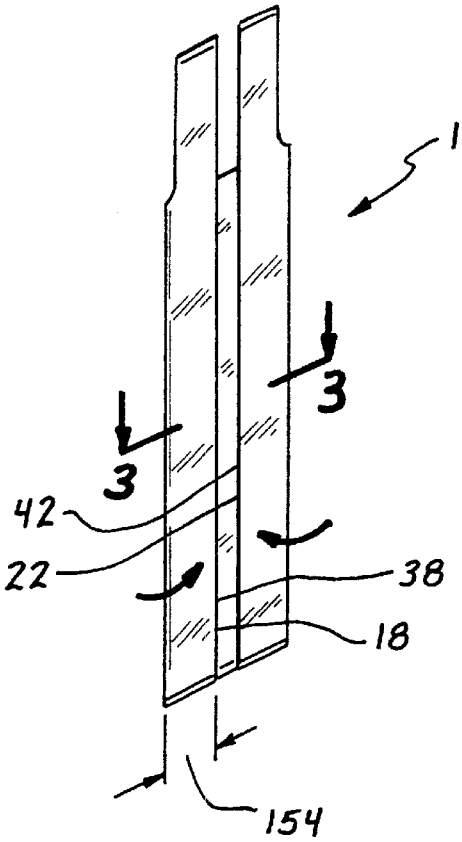
FIG. 1A is a perspective view of the FIG. 1 bag folded inwardly from the parallel side edges.

FIGS. 1, 2, 3 and 4 illustrate a roll mounted plastic produce bag 10 providing the desired features that may be constructed from the following components. A front panel 14 has first 18 and second 22 parallel linear side edges, a top edge 26 and a bottom edge 30. A rear panel 34 has first 38 and second 42 parallel linear side edges, a top edge 46 and a bottom edge 50. Two front gusset panels 54, 58 of a first predetermined dimension 62 are provided. Each front gusset panel 54, 58 has a top edge 62, a bottom edge 66, first 70 and second 74 parallel side edges. The front gusset panels 54, 58 are connected at the first side edge 70 to one of the linear side edges 18, 22 of the front panel 14 and extend from the top edge 26 to the bottom edge 30 of the front panel.

Two rear gusset panels 78, 82 of the first predetermined dimension 62 are provided. Each rear gusset panel 78, 82 has a top edge 86, a bottom edge 90, first 94 and second 98 parallel side edges. The rear gusset panels 78, 82 are connected at the first side edge 94 to one of the linear side edges 38, 42 of the rear panel 34 and extend from the top edge 46 to the bottom edge 50 of the rear panel 34. Each front gusset panel 54, 58 is also connected to a respective one of the rear gusset panels 78, 82 at the second side edge 98. Each of the front 54, 58 and rear gusset panels 78, 82 is folded inwardly relative to the front 14 and the rear panel 34.

The top edges 26, 46, 62, 86 of the front panel 14, the rear panel 34, the front gusset panels 54, 58 and the rear gusset panels 78, 82 terminate in a first perforation line 102. The first perforation line 102 is perpendicular to the linear side edges 18, 22, 38, 42 of the front 14 and rear 34 panels. An upper seam 106 connects the front panel 14, the rear panel 34, the front gusset panels 54, 58 and the rear gusset panels 78, 82 at a level 110 spaced downwardly from and parallel to the first perforation line 102. The bottom edges 30, 50, 66, 90 of the front panel 14, the rear panel 34, the front gusset panels 54, 58 and the rear gusset panels 78, 82 terminate in a second perforation line 114. The second perforation line 114 is perpendicular to the linear side edges 18, 22, 38, 42 of the front 14 and rear 34 panels. A lower seam 118 connects the front panel 14, the rear panel 34, the front gusset panels 54, 58 and the rear gusset panels 78, 82 at a level 122 spaced upwardly from and parallel to the second perforation line 114.

A U-shaped cutout 126 is located in an upper portion 130 of the bag 10. The U-shaped cutout 126 begins at a first point 134 along the first perforation line 102. The first point 134 is spaced inwardly from the first linear side edge 18, 38 and extends to a second point 138 along the first perforation line 102. The second point 138 is spaced inwardly from the second linear side edge 22, 42. The cutout 126 extends downwardly toward the lower seam 118, forming an open mouth 142 and a pair of bag handles 146. The second perforation line 114 attaches the bag 10 to a subsequent bag 10. The bags 10 are rolled from their upper seams 106 toward their lower seams 118 onto a cylindrical core 148 to form a compact roll 150 from which the bags 10 are dispensed.

Figure 2A:
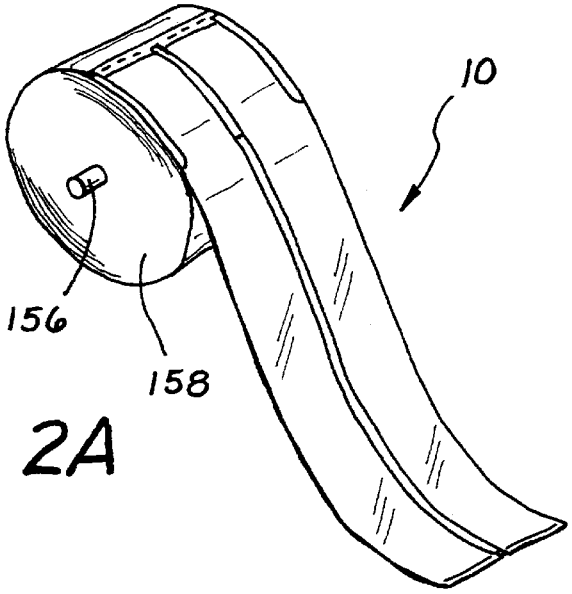
FIG. 2A is a perspective view of a plurality of the FIG. 1 bags folded inwardly from the parallel side edges and rolled onto a cylindrical core suitable for a dispenser.
Figure 3:
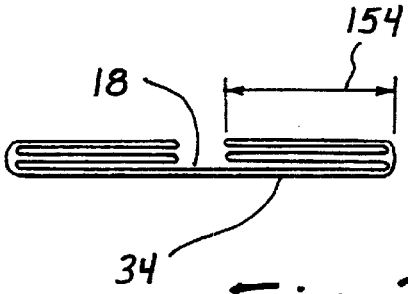
FIG. 3 is a cross sectional view of the FIG. 1A bags taken along the line 5—5.

In a variant of the invention, as illustrated in FIGS. 1A, 2A and 3, the bag 10 is folded inwardly from the first 18, 38 and second 22, 42 linear side edges for a third predetermined dimension 154 prior to rolling the bags 10 onto a cylindrical core 156, thereby providing a more compact roll 158 of bags 10.

Figure 5:
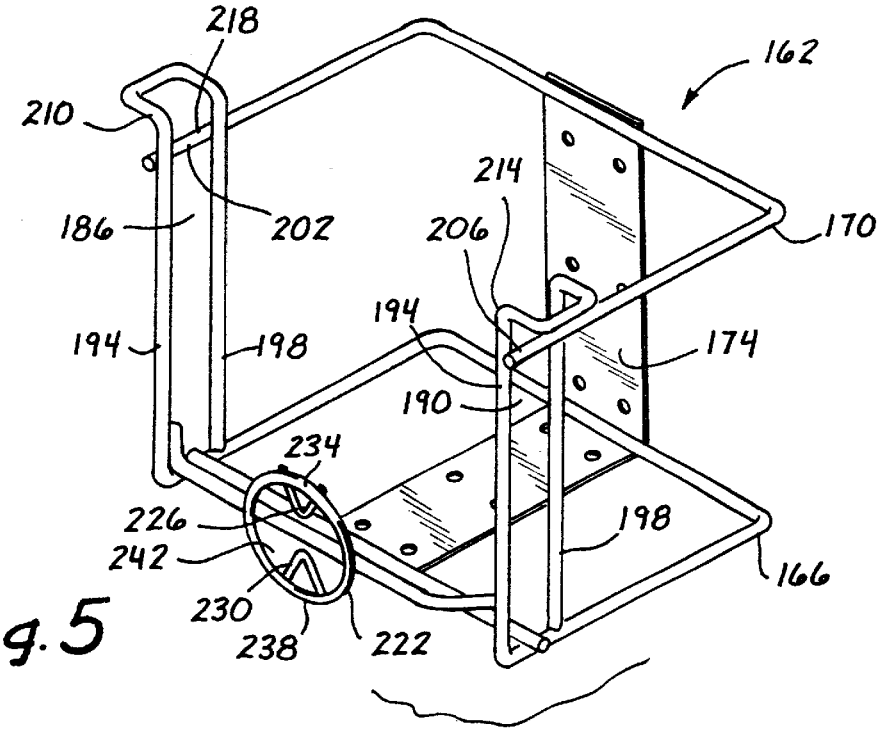
FIG. 5 is a perspective view of a first embodiment of a dispenser suitable for the FIG. 1 rolled bags.
Figure 9:
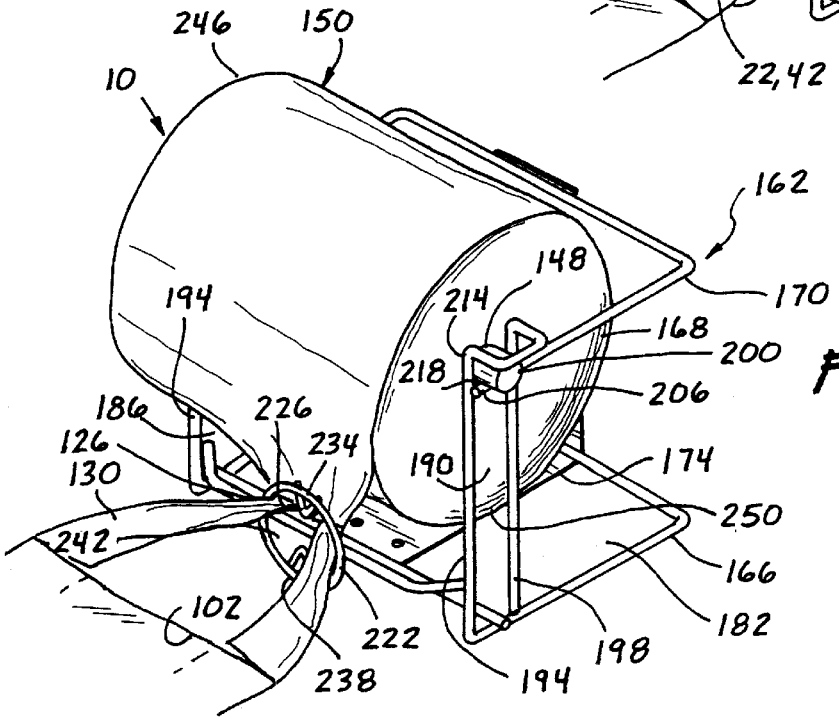
FIG. 9 is a perspective view of the FIG. 5 dispenser with a bag roll installed and the bags feeding from the top of the roll.

In a further variant, as illustrated in FIGS. 5 and 9, a dispenser 162 for roll mounted plastic produce bags 10 includes a supporting base 166 and a surrounding upper member 170. The upper member 170 is spaced upwardly from the supporting base 166 and sized and shaped to enclose at least a rear 168 portion of a bag roll 150. An attachment member 174 is provided. The attachment member 174 is fixedly attached to the supporting base 166 and the surrounding upper member 170 and provides means for securing the dispenser 162 to either a vertical surface 178 or a horizontal surface 182.

First 186 and second 190 parallel, upwardly angled slots are provided. Each of the slots 186, 190 has a front edge member 194 and a rear edge member 198. The slots 186, 190 extend upwardly from the supporting base 166 and connect to and extend above the surrounding upper member 170. The slots 186, 190 are sized, shaped and located to slidably constrain first (not shown) and second 200 ends of a cylindrical produce bag core 146 on which the bags 10 are wound in a roll 150. The angled slots 186, 190 permit the bag core 148 to slide downwardly within the slots 186, 190. First 202 and second 206 core supports are provided. The core supports 202, 206 are located adjacent upper ends 210, 214 of the first 186 and second 190 slots and provide a bearing surface 218 for the produce bag core 146.

A bag constraining ring 222 is provided. The constraining ring 222 is mounted between the front edge members 194 of the upwardly angled slots 186, 190 and is sized and shaped to fit frictionally about a bag 10 as it is removed from the bag roll 150. Upper 226 and lower 230 separating tongues are provided. The upper 226 and lower 230 tongues are affixed to upper 234 and lower 238 portions of the bag constraining ring 222, respectively. The upper 226 and lower 230 tongues point toward an interior 242 of the ring 222 and are sized and shaped to locate the U-shaped cutout 126 in the upper portion 130 of the bags 10 as bags 10 are pulled from the bag roll 150.

When a roll 150 of T-shirt style bags 10 is mounted in the dispenser 162 with its core 148 resting upon the first 202 and second 206 core supports, the roll 150 may be arranged to dispense bags 10 from either of a top 246 and bottom 250 of the bag roll 150. When a leading bag 10 from the roll 150 is fed through the constraining ring 222 adjacent either the upper 226 or lower 230 separating tongues, one of the tongues 226, 230 will serve to engage the U-shaped cutout 126 in the upper portion 130 of the bag 10 and facilitate tearing of the perforation 102 joining the leading bag 10 to a subsequent bag 10 on the roll 150.

Figure 7:
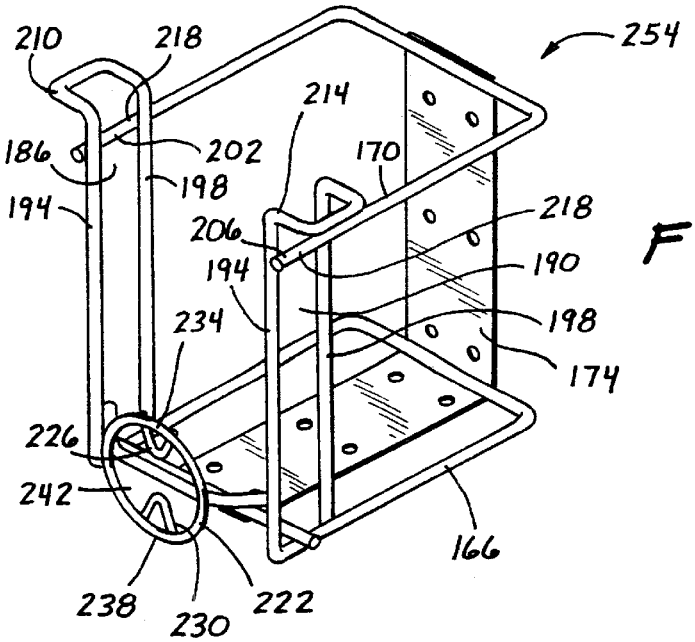
FIG. 7 is a perspective view of the first embodiment of a dispenser suitable for the FIG. 1A rolled bags.
Figure 11:
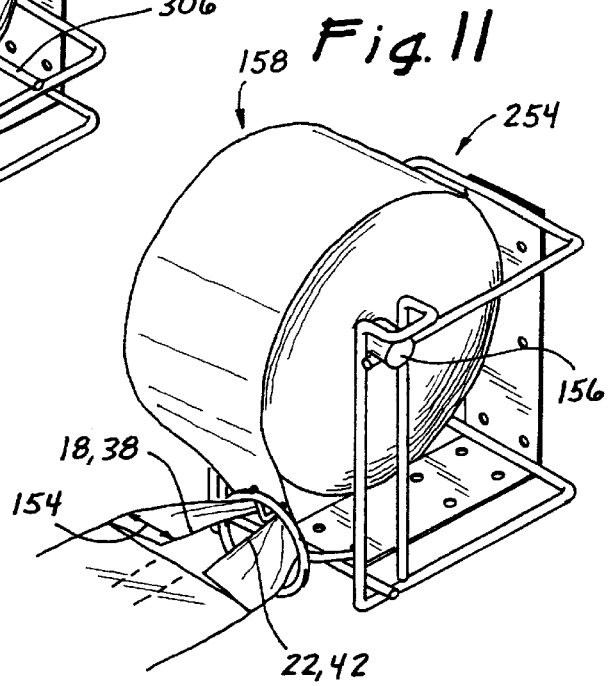
FIG. 11 is a perspective view of the FIG. 7 dispenser with a bag roll installed and the bags feeding from the bottom of the roll.

In still a further variant of the invention, as illustrated in FIGS. 7 and 11, a dispenser 254 is sized and shaped to accommodate produce bags 10 that have been folded inwardly from the first 18, 38 and second 22, 42 linear side edges for a third predetermined dimension 154 prior to rolling the bags 10 onto a cylindrical core 156, thereby providing a more compact roll 158 of bags 10.

Figure 6:
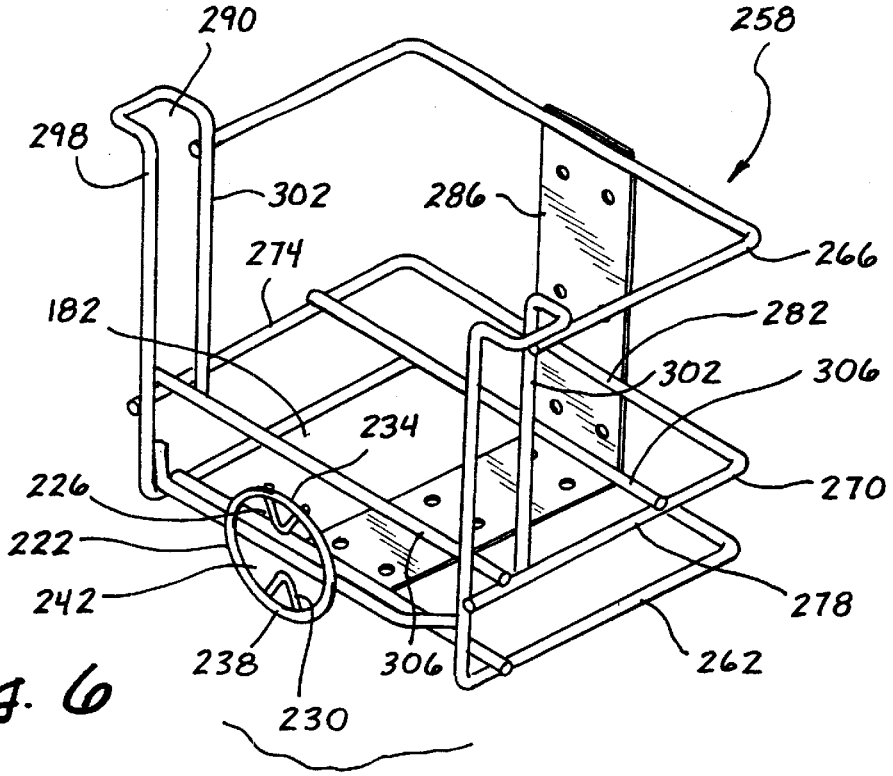
FIG. 6 is a perspective view of a second embodiment of a dispenser suitable for the FIG. 1 rolled bags.

In another variant of the invention, as illustrated in FIG. 6, a dispenser 258 for roll mounted plastic produce bags 10 includes a supporting base 262 and a surrounding upper member 266. The upper member 266 is spaced upwardly from the supporting base 262 and is sized and shaped to enclose at least a rear portion 168 of a bag roll 150. A surrounding intermediate member 270 is provided. The intermediate member 270 has a first side 274, a second side 278 and a rear portion 282. The intermediate member 270 is spaced upwardly from the supporting base 262 and downwardly from the surrounding upper member 266 and is sized and shaped to enclose at least a rear portion 168 of the bag roll 150. An attachment member 286 is provided. The attachment member 286 is fixedly attached to the supporting base 262, the surrounding intermediate member 270 and the surrounding upper member 266 and provides means for securing the dispenser 258 to either a vertical surface 178 or a horizontal surface 182.

First 290 and second 294 parallel, upwardly angled slots are provided. Each of the slots 290, 294 has a front edge member 298 and a rear edge member 302 and extends upwardly from the surrounding intermediate member 270 and above the surrounding upper member 266 and is sized, shaped and located to slidably constrain first (not shown) and second 200 ends of a cylindrical produce bag core 148 on which the bags 10 are wound in a roll 150. The angled slots 290, 294 permit the bag core 148 to slide downwardly within the slots 290, 294. At least one roll bearing bar 306 is provided. The roll bearing bar 306 extends from the first side 274 of the surrounding intermediate member 270 to the second side 278 of the surrounding intermediate member 270.

A bag constraining ring 222 is provided. The constraining ring 222 is mounted between the front edge members 298 of the upwardly angled slots 290, 294 and is sized and shaped to fit frictionally about a bag 10 as it is removed from the bag roll 150. Upper 226 and lower 230 separating tongues are provided. The upper 226 and lower 230 tongues are affixed to upper 234 and lower 238 portions of the bag constraining ring 222, pointing toward an interior 242 of the ring 222. The upper 226 and lower 230 tongues are sized and shaped to locate the U-shaped cutout 126 in the upper portion 130 of the bags 10 as bags 10 are pulled from the bag roll 150.

When a roll 150 of T-shirt style bags 10 is mounted in the dispenser 258 with its core 148 disposed between the front edge member 298 and the rear edge member 302 of the first 290 and second 294 parallel, upwardly angled slots, the roll 150 may be arranged to dispense bags 10 from either a top 246 or bottom 250 of the bag roll. The bag roll 150 rests upon the roll bearing bar 306 and the bar 306 controls movement of the bag roll 150. When a leading bag 10 from the roll 150 is fed through the constraining ring 222 adjacent either of the upper 226 and lower 230 separating tongues, one of the tongues 226, 230 will serve to engage the U-shaped cutout 126 in the upper portion 130 of the bag 10 and facilitate tearing of the perforation 102 joining the leading bag 10 to a subsequent bag 10 on the roll 150.

Figure 8:
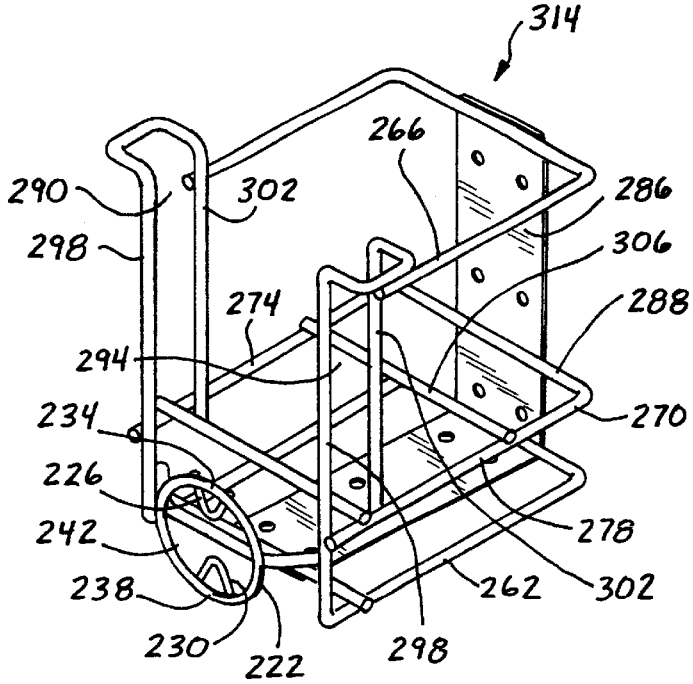
FIG. 8 is a perspective view of the second embodiment of a dispenser suitable for the FIG. 1A rolled bags.
Figure 10:
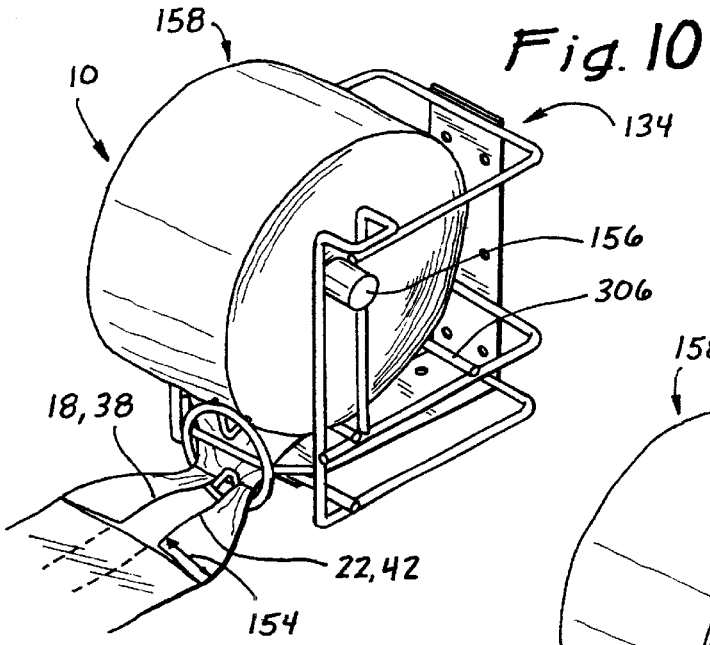
FIG. 10 is a perspective view of the FIG. 8 dispenser with a bag roll installed and the bags feeding from the bottom of the roll.

In still another variant of the invention, as illustrated in FIG. 8, a dispenser 314 for roll mounted plastic produce bags 10 is sized and shaped to accommodate produce bags 10 that have been folded inwardly from the first 18, 38 and second 22, 42 linear side edges for a third predetermined dimension 154 prior to rolling the bags 10 onto a cylindrical core 156, thereby providing a more compact roll 158 of bags 10.

Figure 12:
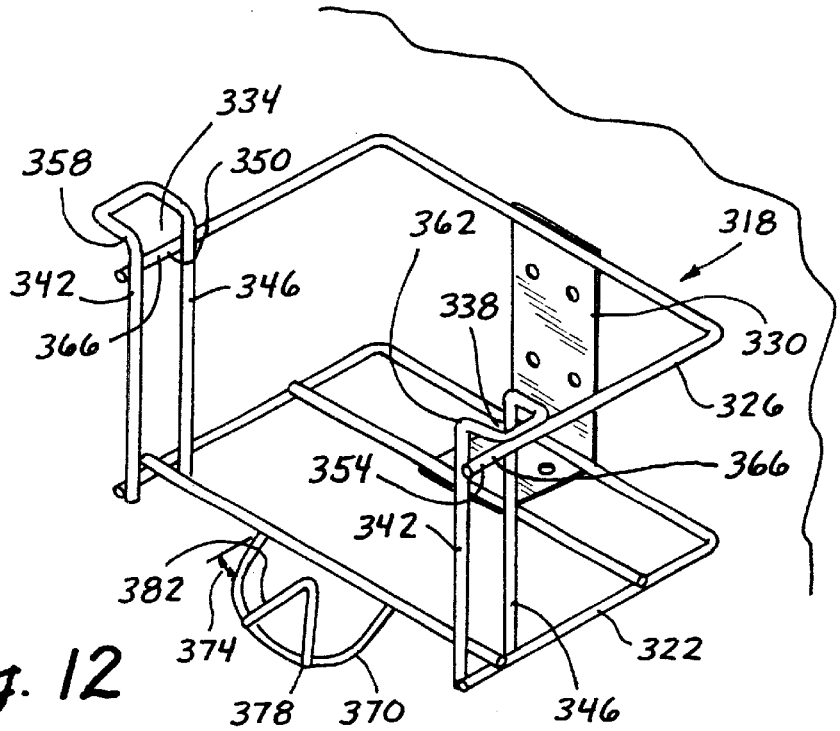
FIG. 12 is a perspective view of a third embodiment of a dispenser suitable for the FIG. 1 rolled bags.

In still another variant, as illustrated in FIG. 12, a dispenser 318 for roll mounted plastic produce bags 10 includes a supporting base 322 and a surrounding upper member 326. The upper member 326 is spaced upwardly from the supporting base 322 and sized and shaped to enclose at least a rear portion 168 of a bag roll 150. An attachment member 330 is provided. The attachment member 330 is fixedly attached to the supporting base 322 and the surrounding upper member 326 and provides means for securing the dispenser 318 to either a vertical surface 178 or a horizontal surface 182.

First 334 and second 338 parallel, upwardly angled slots are provided. Each of the slots 334, 338 has a front edge member 342 and a rear edge member 346. The slots 334, 338 extend upwardly from the supporting base 322 and connect to and extend above the surrounding upper member 326. The slots 334, 338 are sized, shaped and located to slidably constrain first (not shown) and second 200 ends of a cylindrical produce bag core 146 on which the bags 10 are wound in a roll 150. The angled slots 334, 338 permit the bag core 146 to slide downwardly within the slots 334, 338. First 350 and second 354 core supports are provided. The core supports 350, 354 are located adjacent upper ends 358, 362 of the first 334 and second 338 slots and provide a bearing surface 366 for the produce bag core 146.

A tongue mounting loop 370 is provided. The mounting loop 370 is attached between the front edge members 342 of the upwardly angled slots 334, 338 and is positioned at an acute angle 374 to the supporting base 322. A separating tongue 378 is provided. The separating tongue 378 is affixed to a perimeter 382 of the tongue mounting loop 370, pointing inwardly from the perimeter 382, upwardly at the acute angle 374 to the supporting base 322 and is sized and shaped to locate the U-shaped cutout 126 in the upper portion 130 of the bags 10 as bags 10 are pulled from the bag roll 150.

When a roll 150 of T-shirt style bags 10 is mounted in the dispenser 318 with its core 146 resting upon the first 350 and second 354 core supports, the roll 150 is arranged to dispense bags 10 from the bottom 250 of the bag roll 150, a leading bag 10 from the roll 150 is fed over the tongue mounting loop 370 adjacent the separating tongue 378, the tongue 378 will serve to engage the U-shaped cutout 126 in the upper portion 130 of the bag 10 and facilitate tearing of the perforation 102 joining the leading bag 10 to a subsequent bag 10 on the roll 150.

Figure 13:
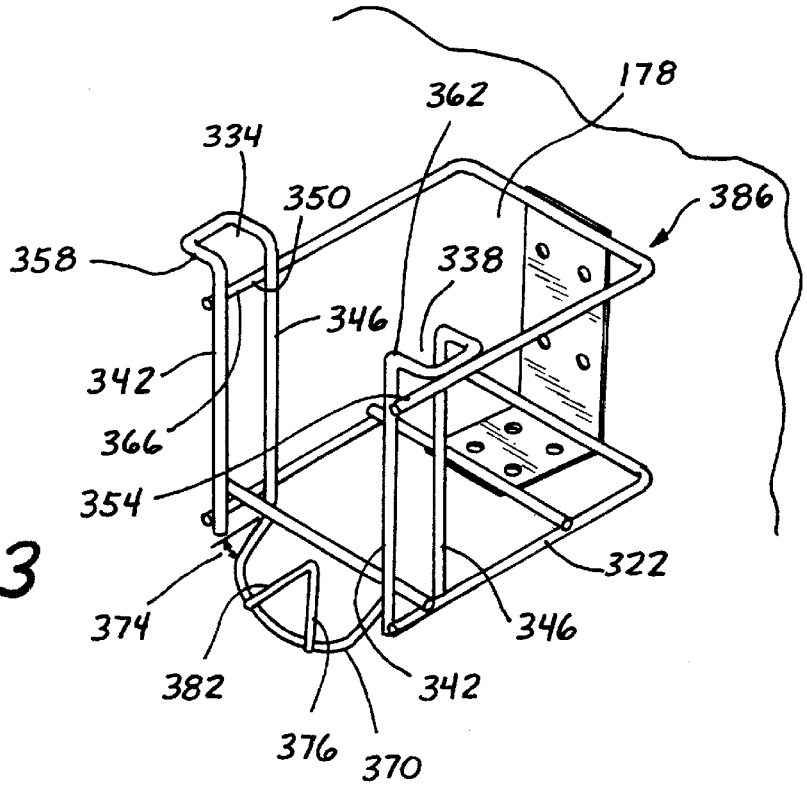
FIG. 13 is a perspective view of the third embodiment of a dispenser suitable for the FIG. 1A rolled bags.

In yet another variant of the invention, as illustrated in FIG. 13, a dispenser 386 is sized and shaped to accommodate produce bags 10 that have been folded inwardly from the first 18, 38 and second 22, 42 linear side edges for a third predetermined dimension 154 prior to rolling the bags 10 onto a cylindrical core 156, thereby providing a more compact roll 158 of bags 10.

Figure 16:
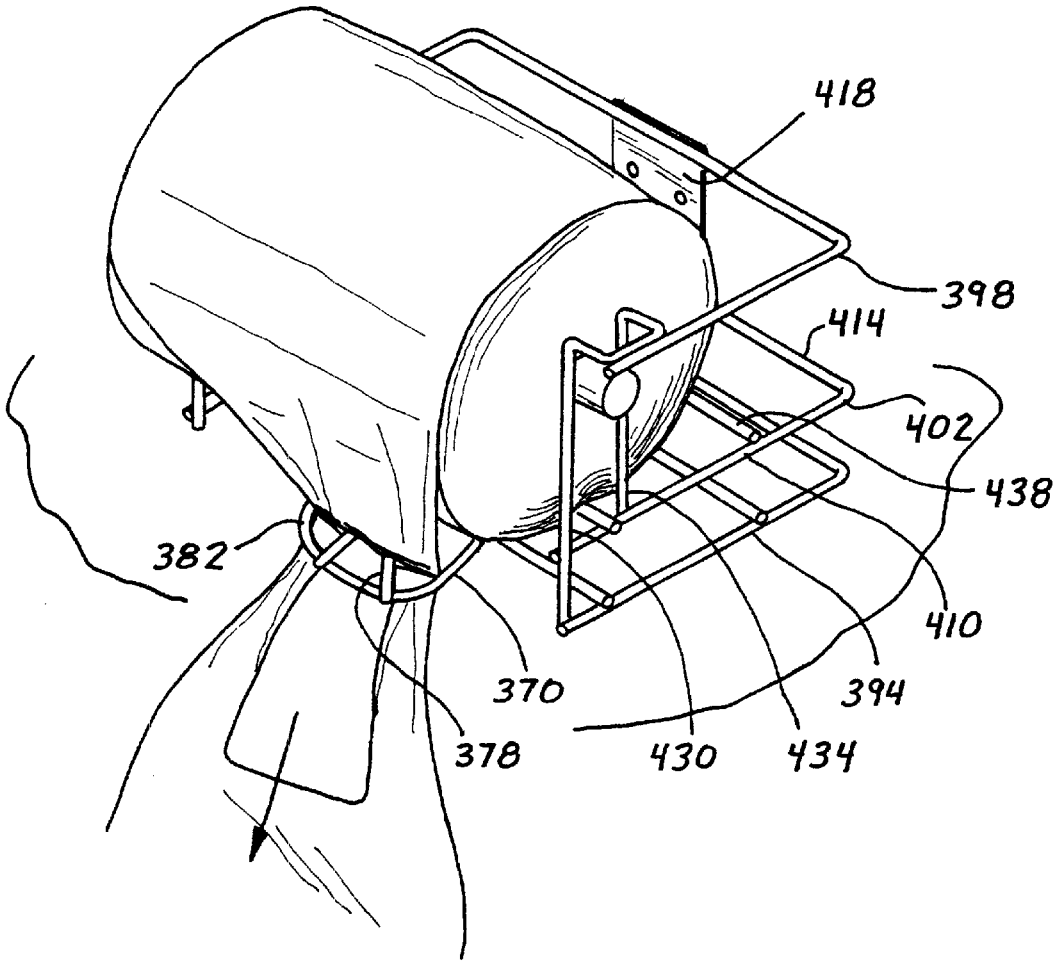
FIG. 16 is a perspective view of the FIG. 14 embodiment of the dispenser with a roll of FIG. 1 rolled bags installed.

In still another variant of the invention, as illustrated in FIGS. 14 and 16, a dispenser 390 for roll mounted plastic produce bags 10 includes a supporting base 394 and a surrounding upper member 398. The upper member 398 is spaced upwardly from the supporting base 394 and is sized and shaped to enclose at least a rear portion 168 of a bag roll 150. A surrounding intermediate member 402 is provided. The intermediate member 402 has a first side 406, a second side 410 and a rear portion 414. The intermediate member 402 is spaced upwardly from the supporting base 394 and downwardly from the surrounding upper member 398 and is sized and shaped to enclose at least a rear portion 168 of the bag roll 150. An attachment member 418 is provided. The attachment member 418 is fixedly attached to the supporting base 394, the surrounding intermediate member 402 and the surrounding upper member 398 and provides means for securing the dispenser 390 to either a vertical surface 178 or a horizontal surface 182.

First 422 and second 426 parallel, upwardly angled slots are provided. Each of the slots 422, 426 has a front edge member 430 and a rear edge member 434 and extends upwardly from the surrounding intermediate member 402 and above the surrounding upper member 398 and is sized, shaped and located to slidably constrain first (not shown) and second 200 ends of a cylindrical produce bag core 146 on which the bags 10 are wound in a roll 150. The angled slots 422, 426 permit the bag core 146 to slide downwardly within the slots 422, 426. At least one roll bearing bar 438 is provided. The roll bearing bar 438 extends from the first side 406 of the surrounding intermediate member 402 to the second side 410 of the surrounding intermediate member 402.

A tongue mounting loop 370 is provided. The mounting loop 370 is attached between the front edge members 430 of the upwardly angled slots 422, 426 and is positioned at an acute angle 374 to the supporting base 394. A separating tongue 378 is provided. The separating tongue 378 is affixed to a perimeter 382 of the tongue mounting loop 370, pointing inwardly from the perimeter 382, upwardly at the acute angle 374 to the supporting base 394 and is sized and shaped to locate the U-shaped cutout 126 in the upper portion 130 of the bags 10 as bags 10 are pulled from the bag roll 150.

When a roll 150 of T-shirt style bags 10 is mounted in the dispenser 390 with its core 146 disposed between the front edge member 430 and the rear edge member 434 of the first 422 and second 426 parallel, upwardly angled slots, the roll 150 is arranged to dispense bags 10 from the bottom 250 of the bag roll 150. The bag roll 150 rests upon the roll bearing bar 438, the bar 438 controlling movement of the bag roll 150 and when a leading bag 10 from the roll 150 is fed over the tongue mounting loop 370 adjacent the separating tongue 378, the tongue 378 will serve to engage the U-shaped cutout 126 in the upper portion 130 of the bag 10 and facilitate tearing of the perforation 102 joining the leading bag 10 to a subsequent bag 10 on the roll 10.

In a final variant of the invention, as illustrated in FIG. 15, a dispenser 442 is sized and shaped to accommodate produce bags 10 that have been folded inwardly from the first 18, 38 and second 22, 42 linear side edges for a third predetermined dimension 154 prior to rolling the bags 10 onto a cylindrical core 156, thereby providing a more compact roll 158 of bags 10.

The roll mounted plastic produce bag 10 and related dispensers 162, 254, 258, 314, 318, 386, 390 and 442 have been described with reference to particular embodiments. Other modifications and enhancements can be made without departing from the spirit and scope of the claims that follow.

What is claimed is:

1. A roll mounted plastic produce bag, comprising:

a front panel, said front panel having first and second parallel linear side edges, a top edge and a bottom edge;

a rear panel said rear panel having first and second parallel linear side edges, a top edge and a bottom edge;

two front gusset panels of a first predetermined dimension, each front gusset panel having a top edge, a bottom edge, first and second parallel side edges and being joined at said first side edge to one of the linear side edges of the front panel and extending from the top edge of the front panel to the bottom edge thereof;

two rear gusset panels of the first predetermined dimension, each rear gusset panel having a top edge, a bottom edge, first and second parallel side edges and being joined at said first side edge to one of the linear side edges of the rear panel and extending from the top edge of the rear panel to the bottom edge thereof;

each front gusset panel also joined to a respective one of said rear gusset panels at said second side edge;

each of the front and rear gusset panels being folded inwardly relative to the front and the rear panel;

the top edges of the front panel, the rear panel, the front gusset panels and the rear gusset panels terminating in a first perforation line, said first perforation line being perpendicular to the linear side edges of the front and rear panels;

an upper seam, said upper seam connecting the front panel, the rear panel, the front gusset panels and the rear gusset panels at a level spaced downwardly from and parallel to said first perforation line;

the bottom edges of the front panel, the rear panel, the front gusset panels and the rear gusset panels terminating in a second perforation line, said second perforation line being perpendicular to the linear side edges of the front and rear panels;

a lower seam, said lower seam connecting the front panel, the rear panel, the front gusset panels and the rear gusset panels at a level spaced upwardly from and parallel to said second perforation line;

a U-shaped cutout, said U-shaped cutout being disposed in an upper portion of the bag and commencing at a first point along the first perforation line spaced inwardly from said first linear side edge and extending to a second point along the first perforation line spaced inwardly from said second linear side edge, said cutout extending downwardly toward the lower seam, thereby forming an open mouth and a pair of bag handles;

said second perforation line attaching the bag to a subsequent bag; and said bags being rolled from their upper seams toward their lower seams onto a core to form a compact roll from which the bags are dispensed.

2. A roll mounted plastic produce bag as described in claim 1, wherein the bag is folded inwardly from the first and second linear side edges for a third predetermined dimension prior to rolling the bags onto a cylindrical core, thereby providing a more compact roll of bags.

3. A dispenser for roll mounted plastic produce bags as described in claim 1, comprising:

a supporting base;

a surrounding upper member, said upper member being spaced upwardly from said supporting base and sized and shaped to enclose at least a rear portion of a bag roll;

an attachment member, said attachment member being fixedly attached to said supporting base and said surrounding upper member and providing means for securing said dispenser to either of a vertical surface and a horizontal surface;

first and second parallel, upwardly angled slots, each of said slots having a front edge member and a rear edge member and extending upwardly from said supporting base and connecting to and extending above said surrounding upper member and being sized, shaped and disposed to slidably constrain first and second ends of a cylindrical produce bag core on which said bags are wound in a roll;

said angled slots permitting said bag core to slide downwardly within said slots;

first and second core supports, said core supports disposed adjacent upper ends of said first and second slots and providing a bearing surface for said produce bag core;

a bag constraining ring, said constraining ring being mounted between said front edge members of said upwardly angled slots and being sized and shaped to fit frictionally about a bag as it is removed from said bag roll;

upper and lower separating tongues, said upper and lower tongues being affixed to upper and lower portions of said bag constraining ring, respectively and pointing toward an interior of said ring and being sized and shaped to locate the U-shaped cutout in the upper portion of the bags as bags are pulled from said bag roll; and whereby, when a roll of T-shirt style bags is mounted in the dispenser with its core resting upon said first and second core supports, the roll may be arranged to dispense bags from either of the top and the bottom of the bag roll, and when a leading bag from the roll is fed through the constraining ring adjacent either of the upper and lower separating tongues, one of said tongues will serve to engage the U-shaped cutout in the upper portion of the bag and facilitate tearing of the perforation joining said leading bag to a subsequent bag on the roll.

4. A dispenser for roll mounted plastic produce bags as described in claim 3, wherein the dispenser is sized and shaped to accommodate produce bags as described in claim 2.

5. A dispenser for roll mounted plastic produce bags as described in claim 1, comprising:

a supporting base;

a surrounding upper member, said upper member being spaced upwardly from said supporting base and being sized and shaped to enclose at least a rear portion of a bag roll;

a surrounding intermediate member, said intermediate member having a first side, a second side and a rear portion and being spaced upwardly from said supporting base and downwardly from said surrounding upper member and being sized and shaped to enclose at least a rear portion of said bag roll;

an attachment member, said attachment member being fixedly attached to said supporting base, said surrounding intermediate member and said surrounding upper member and providing means for securing said dispenser to either of a vertical surface and a horizontal surface;

first and second parallel, upwardly angled slots, each of said slots having a front edge member and a rear edge member and extending upwardly from said surrounding intermediate member and above said surrounding upper member and being sized, shaped and disposed to slidably constrain first and second ends of a cylindrical produce bag core on which said bags are wound in a roll;

said angled slots permitting said bag core to slide downwardly within said slots;

at least one roll bearing bar, said roll bearing bar extending from said first side of said surrounding intermediate member to said second side of said surrounding intermediate member;

a bag constraining ring, said constraining ring being mounted between said front edge members of said upwardly angled slots and being sized and shaped to fit frictionally about a bag as it is removed from said bag roll;

upper and lower separating tongues, said upper and lower tongues being affixed to upper and lower portions of said bag constraining ring, pointing toward an interior of said ring and being sized and shaped to locate the U-shaped cutout in the upper portion of the bags as bags are pulled from said bag roll; and whereby, when a roll of T-shirt style bags is mounted in the dispenser with its core disposed between said front edge member and said rear edge member of said first and second parallel, upwardly angled slots, the roll may be arranged to dispense bags from either of the top and the bottom of the bag roll, said bag roll resting upon said roll bearing bar, said bar controlling movement of the bag roll and when a leading bag from the roll is fed through the constraining ring adjacent either of the upper and lower separating tongues, one of said tongues will serve to engage the U-shaped cutout in the upper portion of the bag and facilitate tearing of the perforation joining said leading bag to a subsequent bag on the roll.

6. A dispenser for roll mounted plastic produce bags as described in claim 5, wherein the dispenser is sized and shaped to accommodate produce bags as described in claim 2.

7. A dispenser for roll mounted plastic produce bags as described in claim 1, comprising:

a supporting base;

a surrounding upper member, said upper member being spaced upwardly from said supporting base and sized and shaped to enclose at least a rear portion of a bag roll;

an attachment member, said attachment member being fixedly attached to said supporting base and said surrounding upper member and providing means for securing said dispenser to either of a vertical surface and a horizontal surface;

first and second parallel, upwardly angled slots, each of said slots having a front edge member and a rear edge member and extending upwardly from said supporting base and connecting to and extending above said surrounding upper member and being sized, shaped and disposed to slidably constrain first and second ends of a cylindrical produce bag core on which said bags are wound in a roll;

said angled slots permitting said bag core to slide downwardly within said slots;

first and second core supports, said core supports disposed adjacent upper ends of said first and second slots and providing a bearing surface for said produce bag core;

a tongue mounting loop, said mounting loop being attached between said front edge members of said upwardly angled slots and being positioned at an acute angle to the supporting base;

a separating tongue, said separating tongue being affixed to a perimeter of said tongue mounting loop, pointing inwardly from said perimeter, upwardly at said acute angle to the supporting base and being sized and shaped to locate the U-shaped cutout in the upper portion of the bags as bags are pulled from said bag roll; and whereby, when a roll of T-shirt style bags is mounted in the dispenser with its core resting upon said first and second core supports, the roll is arranged to dispense bags from the bottom of the bag roll, a leading bag from the roll is fed over the tongue mounting loop adjacent the separating tongue, the tongue will serve to engage the U-shaped cutout in the upper portion of the bag and facilitate tearing of the perforation joining said leading bag to a subsequent bag on the roll.

8. A dispenser for roll mounted plastic produce bags as described in claim 7, wherein the dispenser is sized and shaped to accommodate produce bags as described in claim 2.

9. A dispenser for roll mounted plastic produce bags as described in claim 1, comprising:

a supporting base;

a surrounding upper member, said upper member being spaced upwardly from said supporting base and being sized and shaped to enclose at least a rear portion of a bag roll;

a surrounding intermediate member, said intermediate member having a first side, a second side and a rear portion and being spaced upwardly from said supporting base and downwardly from said surrounding upper member and being sized and shaped to enclose at least a rear portion of said bag roll;

an attachment member, said attachment member being fixedly attached to said supporting base, said surrounding intermediate member and said surrounding upper member and providing means for securing said dispenser to either of a vertical surface and a horizontal surface;

first and second parallel, upwardly angled slots, each of said slots having a front edge member and a rear edge member and extending upwardly from said surrounding intermediate member and above said surrounding upper member and being sized, shaped and disposed to slidably constrain first and second ends of a cylindrical produce bag core on which said bags are wound in a roll;

said angled slots permitting said bag core to slide downwardly within said slots;

at least one roll bearing bar, said roll bearing bar extending from said first side of said surrounding intermediate member to said second side of said surrounding intermediate member;

a tongue mounting loop, said mounting loop being attached between said front edge members of said upwardly angled slots and being positioned at an acute angle to the supporting base;

a separating tongue, said separating tongue being affixed to a perimeter of said tongue mounting loop, pointing inwardly from said perimeter, upwardly at said acute angle to the supporting base and being sized and shaped to locate the U-shaped cutout in the upper portion of the bags as bags are pulled from said bag roll; and whereby, when a roll of T-shirt style bags is mounted in the dispenser with its core disposed between said front edge member and said rear edge member of said first and second parallel, upwardly angled slots, the roll is arranged to dispense bags from the bottom of the bag roll, the bag roll resting upon the roll bearing bar, the bar controlling movement of the bag roll and when a leading bag from the roll is fed over the tongue mounting loop adjacent the separating tongue, the tongue will serve to engage the U-shaped cutout in the upper portion of the bag and facilitate tearing of the perforation joining said leading bag to a subsequent bag on the roll.

10. A dispenser for roll mounted plastic produce bags as described in claim 9, wherein the dispenser is sized and shaped to accommodate produce bags as described in claim 2.

* * * * *